US005938899A

United States Patent [19]

Forand

[11] Patent Number: 5,938,899

[45] Date of Patent: Aug. 17, 1999

[54] ANODE BASKET FOR CONTINUOUS ELECTROPLATING

[76] Inventor: James L. Forand, 4450 Phillip St., Whitehall, Pa. 18052

[21] Appl. No.: 08/958,897

[22] Filed: Oct. 28, 1997

[51] Int. Cl.[6] ..... C25B 9/00

[52] U.S. Cl. ..... 204/259; 204/284; 204/285; 204/286; 204/287; 204/297 R; 204/279; 204/280

[58] Field of Search ..... 204/259, 284, 204/285, 286, 287, 297 R, 279, 280

[56] References Cited

U.S. PATENT DOCUMENTS

| | | | |
|---|---|---|---|
| 2,841,547 | 7/1958 | Kotz et al. | 204/223 |
| 3,223,611 | 12/1965 | Wells et al. | 204/297 |
| 3,862,745 | 1/1975 | Chiz | 204/287 |
| 4,059,493 | 11/1977 | Rice | 204/280 |
| 4,812,211 | 3/1989 | Sakai | 204/287 |
| 4,817,650 | 4/1989 | Tilton | 204/202 |
| 5,340,456 | 8/1994 | Mehler | 204/242 |
| 5,462,649 | 10/1995 | Forand et al. | 205/93 |
| 5,476,578 | 12/1995 | Forand et al. | 204/207 |
| 5,607,561 | 3/1997 | Gruver et al. | 204/297 R |
| 5,620,586 | 4/1997 | Claessens et al. | 204/259 |

*Primary Examiner*—Bruce F. Bell
*Attorney, Agent, or Firm*—Harold I. Masteller, Jr.

[57] ABSTRACT

An anode containment basket for holding soluble anodes in a horizontal plane within the plating bath of a continuous electroplating line. The basket includes a nonconductive conduit having a continuous sidewall, an interior space and open ends. One open end includes an end cap having a nonconductive open web plastic mesh that covers an open space defined by the conduit end. The conduit is positioned within the bath to place the nonconductive open web plastic mesh adjacent and across the horizontal surface of the substrate being electroplated. A conductive grid is housed within the interior space of the conduit, and the grid includes at least one hanger attached to an electrical energy source. The conductive grid both supports and delivers electrical energy to the soluble anodes contained within the basket. The conductive grid is positioned adjacent the nonconductive open web plastic mesh so that the soluble anodes occupy the open space of the anode containment basket that extends across the horizontal plane of the substrate being plated.

49 Claims, 7 Drawing Sheets

30
30
30
30
28
28
28
28
29
29
29
29
25
T
27
26
31
22
24
24
20
21
24
24
23
34
36
32
33
35

T
31
21
24
20
59
28
24
33
26
60
32
61
62
23
31
27
D
14
36
64
63
52
D
56
51
60
53
37
B1
51
43
44
50
46
40
13

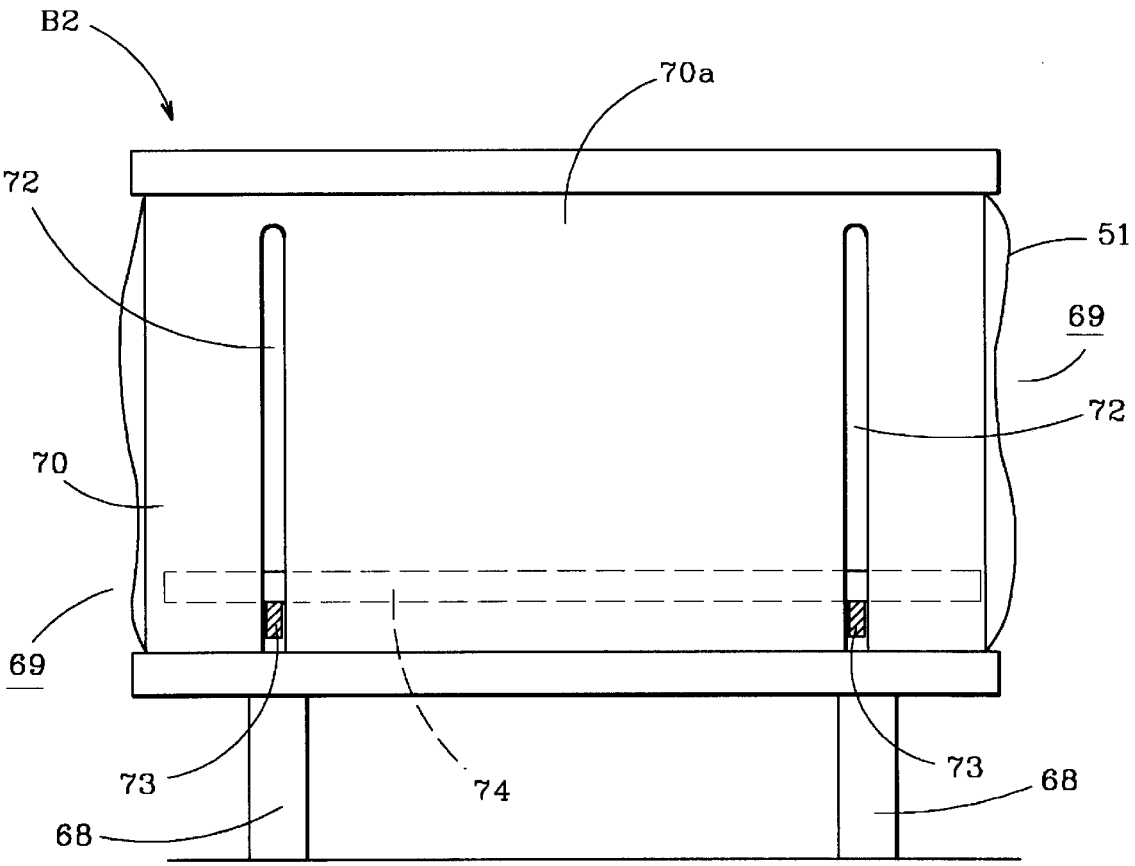
Fig. 7
Fig. 8
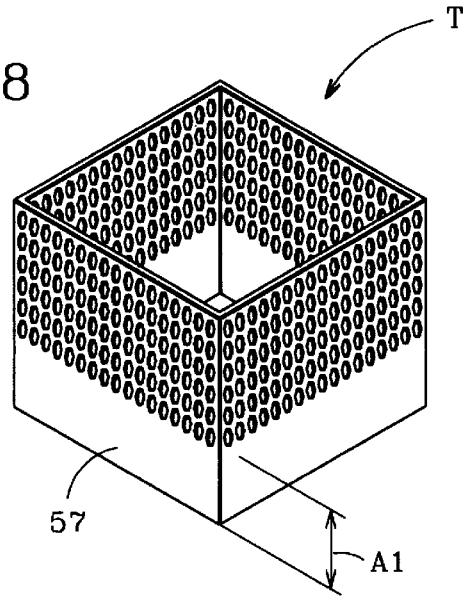

ANODE BASKET FOR CONTINUOUS ELECTROPLATING

BACKGROUND OF THE INVENTION

This invention is related to a containment basket for holding soluble anodes within the plating bath of a continuous plating line, and in particular, it is directed to a rigid, dielectric containment basket for holding soluble anodes in a horizontal plane adjacent to the surface of a sheet metal substrate being electrolytically plated in a continuous coil plating line.

It has been recognized, for example, in the present inventor's U.S. Pat. No. 5,476,578, that plating efficiency can be increased through strategic placement of the soluble anodes with respect to the substrate surface being plated. This earlier patent teaches that in a continuous high speed electroplating line, plating productivity can be improved by increasing the deposition rate of metallic coatings from the plating solution. In order to increase plating rates, the top and bottom anodes are positioned to within about ⅛" to ⅝" from the surface of the continuous flat rolled sheet product being plated. Through such strategic anode placement, in actual reduction to practice, the inventor has increased plating rates up to about 4 times faster than prior state-of-the-art electroplating technology.

However, it has also been discovered that during such electroplating operations, where the soluble anodes are contained in conductive baskets, stray electrical cross currents are emitted from the anode baskets. Anode baskets are typically manufactured from non-corrosive conductive materials such as titanium. When a plurality of such conductive baskets are arranged in a closely, spaced apart relationship, stray electrical cross currents jump the gap between adjacent baskets and form nuclei of metallic salts on basket sidewalls. These same electrical cross currents can also jump gaps and form nuclei on the plating tank sidewalls, or any other conductive equipment and apparatus contained within the tank. The nuclei or small deposits act as "thieves", that steal more and more salts and/or metals from the plating bath and thereby rob energy from the plating operation. If such salt deposits are allowed to remain in the plating tank, they will continue to grow until their increased weight causes them to break free from the baskets or walls. The free deposits either fall onto the surface of the plated sheet product, or are pulled upward into the plated product by the hydraulic surge that is created within the plating bath from the fast high speed sheet product moving through the tank. In either case, contact with the sheet steel product surface will cause damage to the plated surface and reduce product quality. In order for plating line operators to prevent such product damage, it is necessary to schedule periodic cleaning and maintenance to remove accumulated salt and/or metallic deposits from the anode baskets as well as from any other conductive surfaces and equipment within the tank that accumulate such deposits.

Additionally, it is well known that fabric or filter bags can be used with anodes to collect small particles that fall from the anodes to prevent contamination of the plating bath, and to prevent damage to the surface of the substrate. Typically, such filter bags encircle anodes that are suspended within a batch-plating bath. Filter bags present no problems in batch plating, where the plated product hangs motionless within the tank. However, in a high speed continuous plating line, where the product travels at high speeds through the bath, sludge collection bags present an array of problems. For example, in instances where the anodes are moved into close proximity with the coating surface of the substrate, to increase plating rates as taught in the present inventor's earlier patent, the forced hydraulic action created by the fast moving substrate causes the sludge bags to festoon outward toward the plated product. This can cause the filter bag to contact the moving product and damage the product by scratching the plated surface. In a worse case scenario, where the sharp edges of the speeding sheet metal strip make contact with the filter bags, the bags are ripped open and the sludge contents are poured out into the plating tank, and onto the plated sheet metal substrate. This destroys large amounts of product and contaminates the plating bath. Such events result in plant shutdown for cleaning and maintenance.

SUMMARY OF THE INVENTION

It is therefore the primary object of the disclosed invention to provide a dielectric anode containment basket for holding soluble anodes in a horizontal plane proximate the coating surface of a rolled flat sheet metal product being plated in a continuous high speed electroplating line.

It is a further object of this invention to provide a dielectric containment basket that will reduce accumulation of salt and/or metal deposits within an electroplating tank.

It is a further object of this invention to provide a nonconductive anode basket that will diminish cross current flow within a plating bath and reduce the deposition of salts and/or metals on plating apparatus.

It is still a further object of this invention to provide a rigid dielectric containment basket that will reduce maintenance requirements by slowing the rate of stray salt and/or metal deposits that form within the plating tank.

It is still a further object of this invention to provide a rigid dielectric anode containment basket that prevents a filter bag from festooning and contacting a moving substrate.

Other objects and advantages of the present invention will become apparent from the following detailed description thereof.

In satisfaction of the foregoing objects and advantages, the present invention provides an anode containment basket for holding soluble anodes in a horizontal plane within the plating bath of a continuous electroplating line. The basket includes a nonconductive conduit having a continuous sidewall, an interior space and open ends. One open end includes an end cap having a nonconductive open web plastic mesh that covers an open space defined by the conduit end. The conduit is positioned within the bath to place the nonconductive open web plastic mesh adjacent and across the horizontal surface of the substrate being electroplated. A conductive grid is housed within the interior space of the conduit, and the grid includes at least one hanger attached to an electrical energy source. The conductive grid both supports and delivers electrical energy to the soluble anodes contained within the basket. The conductive grid is positioned adjacent the nonconductive open web plastic mesh so that the soluble anodes occupy the open space of the anode containment basket that extends across the horizontal plane of the substrate being plated.

BRIEF DESCRIPTION OF THE DRAWINGS

FIG. 7 is an end view taken along the lines 7—7 of FIG. 6

FIG. 8 is an isometric view showing an alternate conduit for a top anode containment basket.

DETAILED DESCRIPTION OF THE PREFERRED EMBODIMENT

Figure 1:
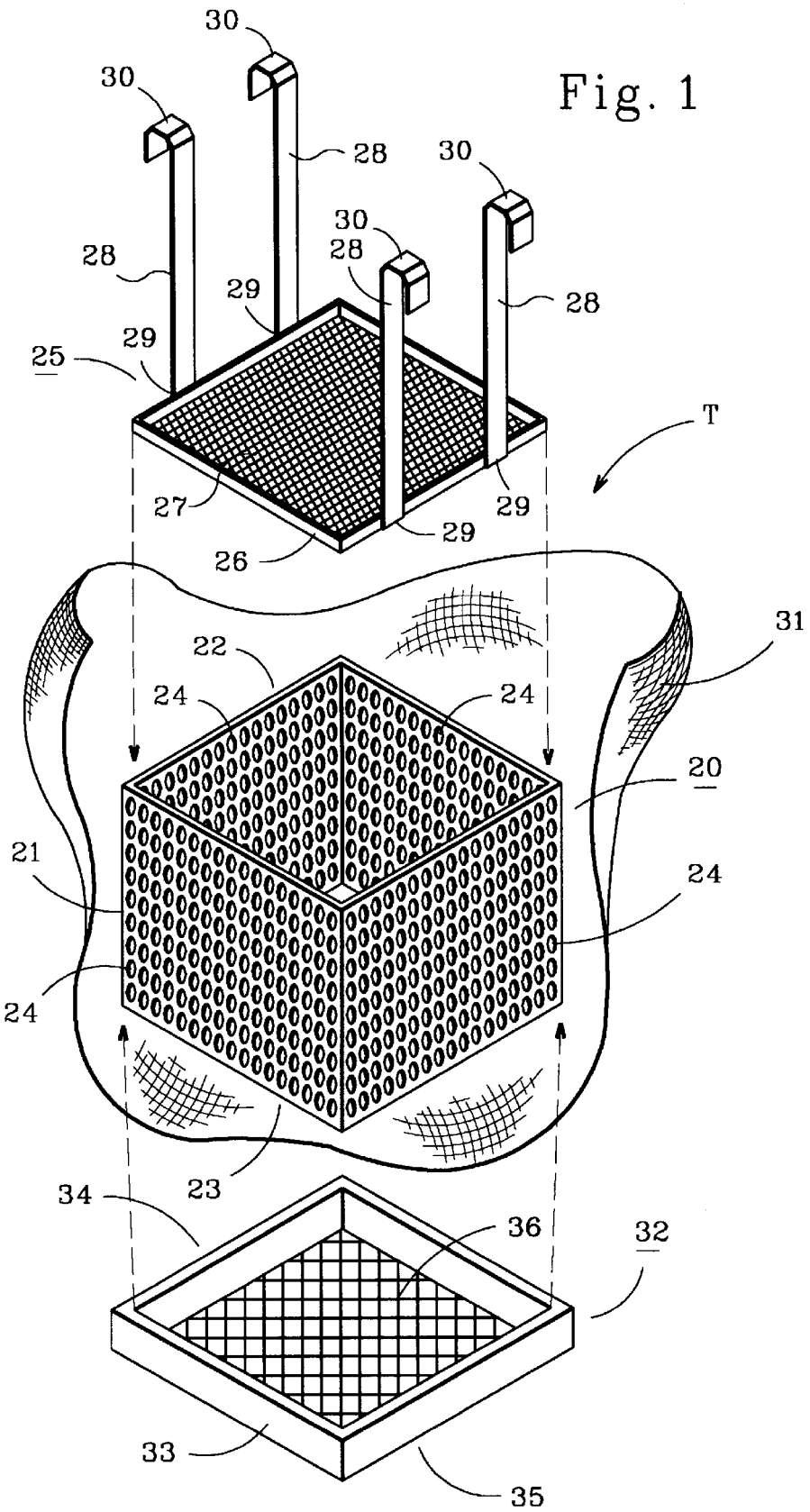
FIG. 1 is an exploded isometric view of a top anode containment basket.
Figure 2:
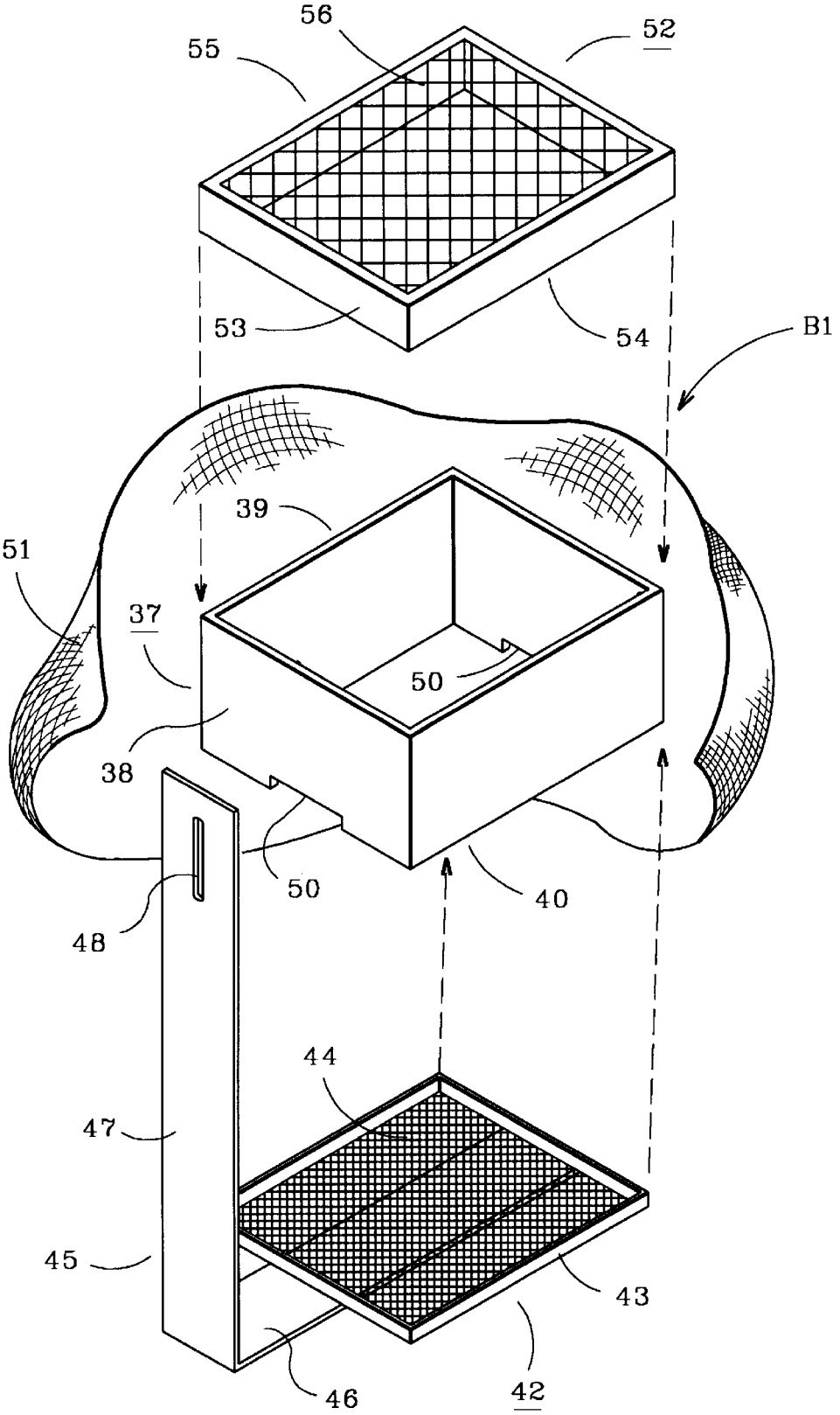
FIG. 2 is an exploded isometric view of a bottom anode containment basket.
Figure 3:
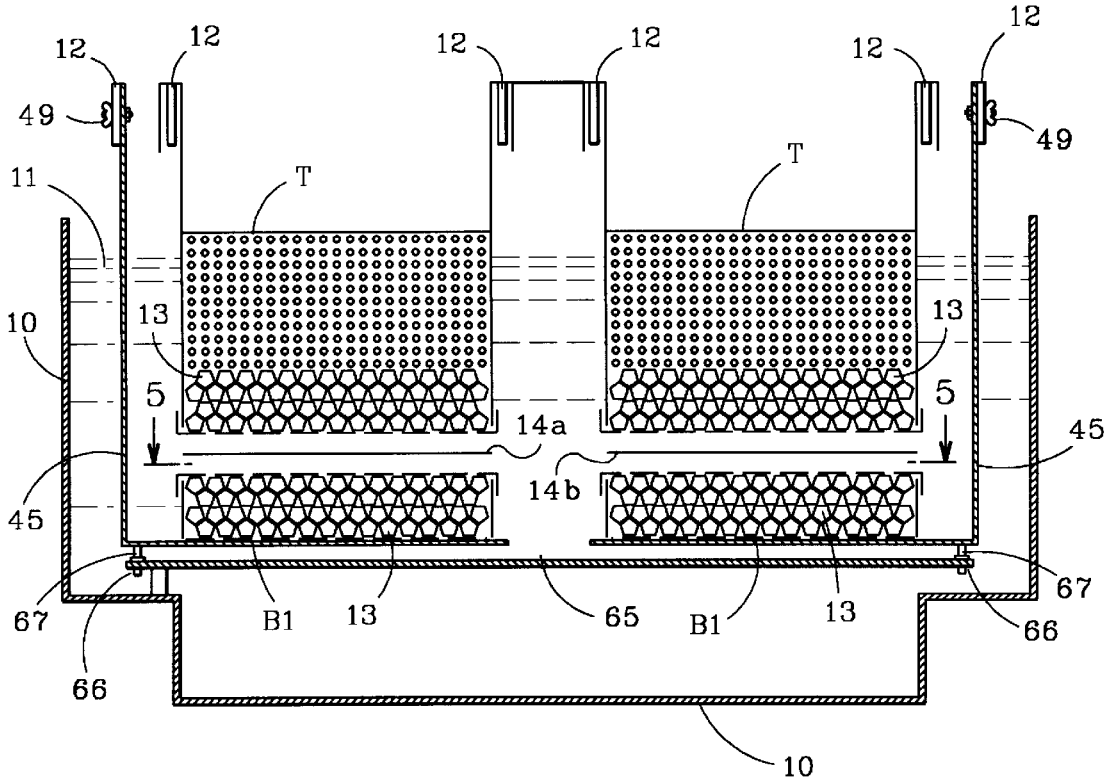
FIG. 3 is a schematic transverse cross-section view taken through a high speed electroplating tank.

Referring to FIGS. 1–3 of the drawings, an exemplary two strand continuous electroplating line is shown in FIG. 3 comprising a tank 10 containing an electroplating bath 11, and bus bars 12 for delivering current from a power source to anodes 13 immersed within bath 11. The anodes are shown contained within dielectric containment baskets in accordance with the preferred embodiment of the present invention including a top containment basket "T" and a bottom containment basket "B1." The exemplary plating line shows two rows of spaced apart top anode containment baskets "T" positioned adjacent the top surface of substrates 14*a* and 14*b*, and two rows of spaced apart bottom anode containment baskets "B1" positioned adjacent the bottom surface of the substrates 14*a* and 14*b*. This arrangement positions and holds the soluble anodes 13 in a horizontal plane adjacent the coating surface of the substrate being plated. It should be understood, however, that any reasonable basket/substrate arrangement may be used without departing from the scope of this invention. For example, the plating tank shown in FIG. 3 could just as well be a single strand plating line comprising a single row of top containment baskets "T" and a single row of bottom containment baskets "B1" positioned adjacent a single substrate. Additionally, the top and bottom containment basket arrangements could comprise elongated top and bottom dielectric baskets that span multiple strands of substrate.

Referring now to the exploded view in FIG. 1, the preferred embodiment for the top containment basket "T" is shown comprising a rigid, porous conduit or tubular section 20 having a continuous sidewall 21 and a first open end 22 opposite a second open end 23. Conduit 20 is manufactured from any suitable, rigid, dielectric material such as polypropylene or the like, and a plurality of apertures 24 is drilled through the rigid continuous sidewall 21 to provide porosity.

In the preferred embodiment, the size and arrangement of the apertures 24 is such that less than about 25% of the continuous sidewall is open space. This provides a large dielectric barrier that minimizes the amount of stray cross currents that are emitted from the basket sidewall, and thereby directs more electrical energy from the anodes in the basket to the cathode, which in this case is the flat rolled strip being electroplated. In actual reduction to practice, it has been found that by reducing stray cross current flow electrical energy consumption becomes more efficient and power costs are reduced at such plating operations.

In an exemplary anode basket comprising a sidewall measuring two feet in height and two feet by two feet square, about 12,000, ¼" diameter holes need to be drilled through the sidewall to provide a 25% open space area. Similarly, if larger 2" diameter holes drilled through the sidewall, only about 183 holes are needed to provide a 25% open space area through the sidewall.

It should be understood, however, that the above examples are not intended to limit the scope of the invention to a specific number or percentage of apertures that extend through the basket sidewall 21. These examples are only based on the preferred embodiment and are not intended to limit the scope of the invention. Any larger number, or smaller number, of apertures 24 may be drilled through top or bottom basket sidewalls as long as a balance is maintained between replacement of electrolyte within the basket and reduction of stray cross current flow from the anode containment baskets.

Electrolyte replacement is an important consideration in selecting the number of apertures that extend through an anode containment basket sidewall. During continuous electroplating, the flat sheet product, which is the cathode, travels through the bath at a high speed. This creates a forced hydraulic action that pulls electrolyte from the bottom, open end, of the top basket and onto or next to the top coating surface of the substrate. In order to maintain a continuous electrolyte concentration within the top basket, fresh electrolyte is introduced into the anode containment basket through the apertures that are drilled through the conduit sidewall. Therefore, it is important to select a proper number of apertures to insure that electrolyte concentration remains at a constant necessary level, and provide sufficient solid area in the conduit to reduce the stray cross current flow to a level where nuclei are no longer formed on the plating equipment, or other ancillary hardware in the plating tank.

The top containment basket further includes a conductive, anode support assembly 25 comprising a frame 26, an expanded metal screen 27, and hangers 28. Screen 27 provides a conductive surface that supports the soluble anode material 13 during electroplating, as shown in FIG. 3. Referring again to FIG. 1, the conductive hangers include a first end 29 attached to frame 26, and an opposite end 30 that includes means for attaching the hangers to the bus bars 12 shown in FIG. 3 to deliver electrical energy to the metal grid 27.

The anode support assembly 25 is manufactured from any non-corrosive conductive material such as titanium. Frame 26 is shaped to slideably fit within the continuous sidewall 21 of conduit 20, and the framed screen 27 is positioned to locate the screen adjacent open end 23 with the hanger ends 30 extending outward from open end 22.

Figure 4:
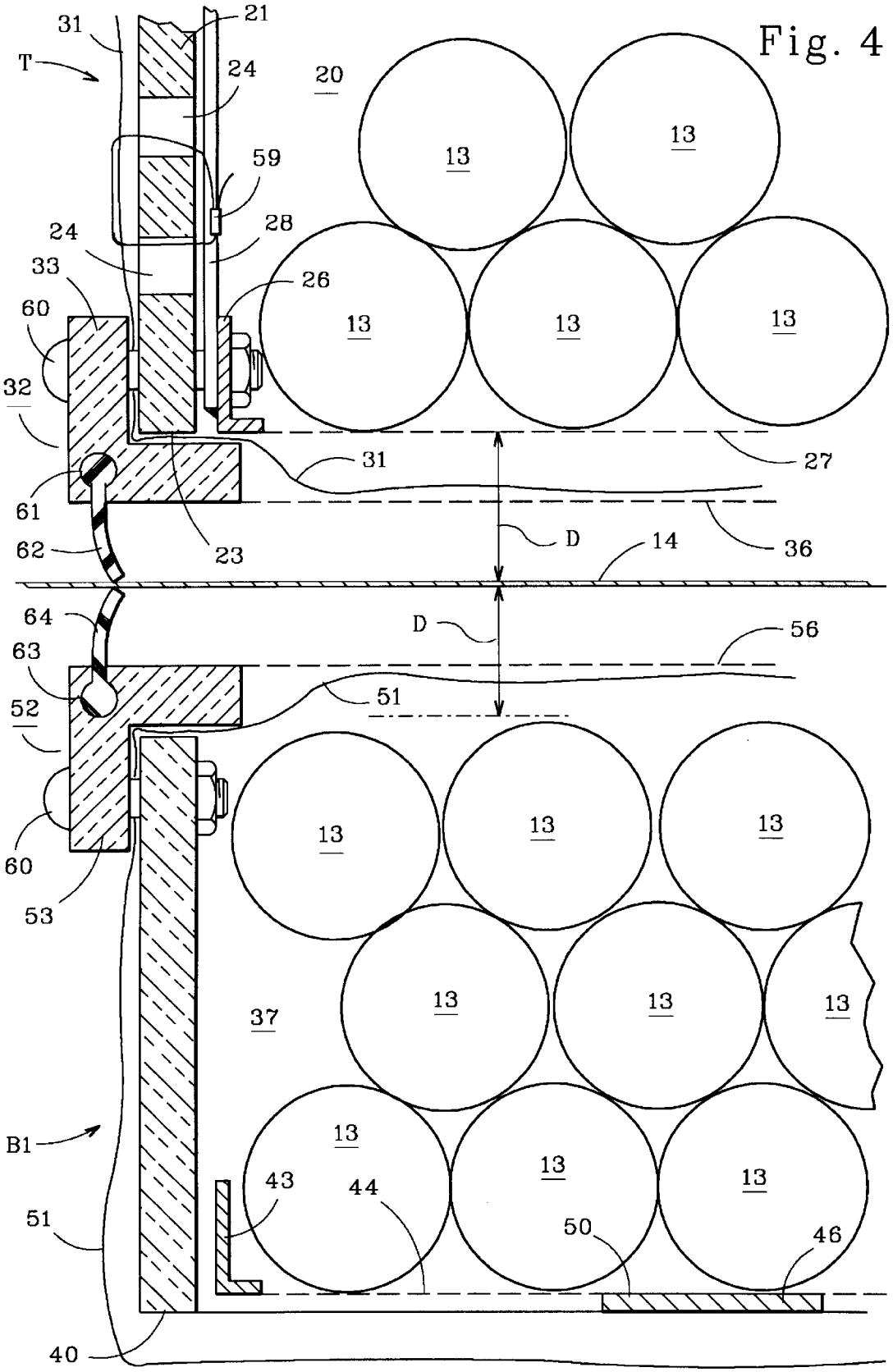
FIG. 4 is a cross-section view showing enlarged portions of top and bottom anode containment baskets.

Referring to FIG. 4, frame 26 is mechanically fastened to the conduit 20 with screws, bolts or the like to prevent the two basket components from separating, see FIG. 4. The assembled unit is inserted into a fabric filter bag 31, shown in FIGS. 1 and 4, that encircles conduit 20 with the hangers extending from the bag.

A nonconductive end cap 32, manufactured from a material similar to conduit 20, is slipped over the open end 23 of the fabric-encased conduit. End cap 32 includes a frame 33 having an open end 34 shaped to encircle the fabric-encased conduit 20, and a screen end 35 that includes an openweb plastic mesh 36, manufactured from polypropylene or the like, attached to frame 33. The end cap is also fastened to conduit 20 with screws.

Referring now to FIG. 2, a bottom containment basket "B1" for holding soluble anodes adjacent the bottom surface of a substrate being plated in a continuous electroplating line is shown including a nonconductive conduit or tubular member 37. The bottom containment basket also includes a continuous sidewall 38 and a first open end 39 opposite a second open end 40. The conduit is manufactured from any rigid dielectric material such as polypropylene or the like, and a plurality of apertures 41 is drilled through the continuous sidewall 38 to provide porosity as disclosed for the top anode containment basket "T".

The bottom containment basket also includes a conductive, anode support assembly 42 comprising a frame 43, an expanded metal screen 44, and a hanger 45. Screen 44 provides a conductive surface that supports anode material 13 (FIG. 3) and delivers electrical energy to the anodes during electroplating. The conductive hanger comprises an "L" shaped bracket and includes a first leg 46 and a second leg 47. Leg 46 is welded to a metallic support frame 43. The second, vertical leg 47 includes an elongated slot 48 that extends through the leg for attaching the hanger to a bus bar 12 to deliver electrical energy to conductive screen 44 as shown in FIG. 3. Slot 48 provides means for adjusting the vertical position of the bottom anode containment basket "B1" within the plating tank by loosening the bus bar fastener 49 (FIG. 3) that extends through slot 48. The hanger is then either raised or lowered to position the basket "B1" with respect to the bottom surface of the substrate being plated.

The anode support assembly 42 is manufactured from any non-corrosive conductive material such as titanium. Frame 43 is shaped to slideably fit within the continuous sidewall 38 of conduit 37 and sidewall 38 includes notches 50 to positioned screen 44 flush with the open end 40.

Frame 43 is fastened to conduit 37 with screws or the like to prevent the two basket components from separating, see FIG. 2. The assembled unit is inserted into a fabric filter bag 51 that encircles conduit 37, the hanger legs 46 and 47, and the anode support assembly, and hanger leg 47 extends outward from the bag to communicate with a bus bar attached to an electrical energy source.

A nonconductive end cap 52, manufactured from material similar to conduit 37, is slipped over the open end 39 of the fabric-encased conduit. End cap 52 includes a frame 53 having an open end 54 shaped to capture the fabric-encased conduit 37, and a screen end 55 that includes an openweb plastic mesh 56 made of polypropylene or high density polyethylene, or the like, attached to frame 53. The end cap is also fastened to conduit 20 with screws, or other fastening means such as welding, tie straps, etc.

An alternate conduit embodiment is shown in FIG 8 of the drawings. FIG. 8 shows a top basket conduit having a solid continuous sidewall portion 57 that extends along the perimeter of the conduit at a depth "A1" equal to about the depth freshly packed anodes occupy in the conduit at the start of a plating operation. Referring to the enlarged cross-section view shown in FIG. 4, a top anode containment basket "T" and a bottom anode containment basket "B1" are shown positioned adjacent the top and bottom coating surfaces of a substrate (the cathode). As more clearly shown in the enlarged cross-section, the basket "T" includes a conduit 20 having a continuous sidewall 21 through which a plurality of apertures 24 is drilled. The conductive screen or metallic grid 27, attached to frame 26 of the anode support assembly, is positioned adjacent the opening 23 of conduit 20. This positions the soluble anodes 13 adjacent the coating surface of the substrate, and the fabric filter bag 31 encircles the conduit/anode support assembly. The filter bag is held in place against the outside surface of the conduit with self-locking plastic ties 59, or the like, that are inserted through the apertures 24 in the sidewall. The end cap 32 is slipped over the fabric-encased conduit and attached thereto with fasteners 60. As clearly shown in the enlarged figure, bag 31 is captured between the conductive grid 27 of the anode support assembly, and the nonconductive open-web plastic mesh 36 of the end cap 32. This prevents the bag from festooning outward toward the substrate in response to the forced hydraulic action generated by the rapid speed of the substrate strip moving through the plating bath, and eliminates the problems set forth above.

The basket "B1" includes a solid conduit 37. The conductive anode support assembly, frame 43, and grid 44 that holds the anodes 13, is positioned adjacent the opening 40 of conduit 37. The fabric filter bag 51 is placed over the assembly to encircle the conduit/anode support assembly, and the filter bag is held in place against the outside surface of the conduit by mechanical fastening means. The end cap 52 is slipped over the fabric-encased conduit and attached thereto with fasteners 60, and the basket is adjusted via slot 48, as heretofore disclosed, to position the soluble anodes adjacent the bottom surface of the substrate. As clearly shown, bag 51 is captured between the soluble anodes 13 and the open-web plastic mesh 56 of the end cap 52. This prevents the bag from festooning outward in response to the forced hydraulic action generated by the rapid speed of the substrate strip moving through the plating bath and eliminates the problems set forth above.

The preferred distance "D", shown in FIG. 4, between the anodes and the cathodes is between about ⅛" to ⅝", as taught in the present inventor's earlier U.S. Pat. No. 5,476,578. Additionally, U.S. Pat. No. 5,476,578, as well as related U.S. Pat. No. 5,462,649, teach using wiper blades to remove hydrogen bubbles from the surface of the substrate being plated to insure that there is a rapid change of electrolytic coating solution next to the coating surface of the substrate. Such wiper blades are used with the present invention to prevent depletion of the electrolyte and therefore, U.S. Pat. No. 5,476,578 and U.S. Pat. No. 5,462,649 are hereby incorporated into this application by reference.

Although the preferred embodiments disclosed in FIGS. 1 and 2 show anode containing baskets having end caps 32 and 52, it should be understood that the non conductive conduits could also be used without end caps fastened to their second open ends 23 and 40. However, in such instances, if the second open ends 23 and 40 are positioned within the preferred ⅛" to ⅝" distance "D," shown in FIG. 4, the soluble anodes must be positioned about ¼" inward from their respective second open ends 23 or 40 to prevent arching with the moving sheet metal substrate. Such an anode arrangement will deliver fresh electrolyte to the coating surface of the substrate. However, it is less inefficient because the ¼", fully charged starting position, places the anodes farther from the moving substrate. The larger gap "D" will slow plating rates, consume more electricity and may reduce surface quality in the plated product.

Referring again to FIG. 4, the end cap 32, of the top anode containment basket "T," is shown comprising a frame 33 having a slotted portion 61 shaped to receive one end of a resilient wiper blade 62. The wiper blade extends outward from frame 33 and contacts the top coating surface of the substrate 14 to remove a composite barrier that accumulates on the coating surface of the substrate during electroplating operations.

During electroplating, a composite barrier comprised of hydrogen bubbles, a micro-ion depletion layer, and a thermal barrier is formed. This barrier will prevent, or at least reduce, a rapid change of fresh electrolyte next to the substrate surface. The micro-ion depletion layer includes a layer of water that is formed at the plating interface during the ionic exchange. For example, where the metal cation $Cu^{2+}$ precipitates out as a solid metal onto the coating surface of the substrate, the $Cu^{2+}$ solution goes from being an electrolyte to a non-electrolyte and a micro-ion depleted layer of water is formed. Unless fresh electrolyte is introduced at the plating interface the plating rate or speed will fall off. It is difficult for ions to penetrate the layer of hydrogen bubbles at the plating interface. The larger bubbles prevent the smaller ions, about 50 angstroms, from reaching the plating interface. The thermal layer, generated by heat of formation, causes the water layer to vaporize and form gas bubbles i.e. steam that small ions cant's penetrate.

If this condition is allowed to continue, the electrolyte depletion rate will exceed the amount of fresh electrolyte that reaches the plating interface, and very poor quality product will be produced. The combination of the wiper blades 62 and the apertures 24 that extend through the sidewall of the rigid plastic anode basket insure an ample supply of fresh electrolyte at the coating interface. The wiper blades sweep away the composite layer and thereby facilitate a rapid exchange of fresh electrolyte at the plating interface. Forced hydraulic action, produced by the sheet or strip moving through the plating bath, creates a flow of fresh electrolyte from the plating tank, through the anode containing basket, and into the plating gap extending across the horizontal surface of the substrate being plated. The hydraulic action continually draws electrolyte from the bottom end of the anode containing basket that is positioned adjacent the strip, and pulls fresh replacement electrolyte from the plating tank through the apertures 24 and into the anode basket.

Similarly, end cap 52, of the bottom anode containment basket "B1," is shown comprising a frame 53 having a slotted portion 63 shaped to receive one end of a resilient wiper blade 64. The wiper blade extends outward from frame 53 and contacts the coating surface of the cathode or substrate 14 to remove any accumulated hydrogen bubbles and insure a rapid change of fresh electrolytic coating.

Figure 5:
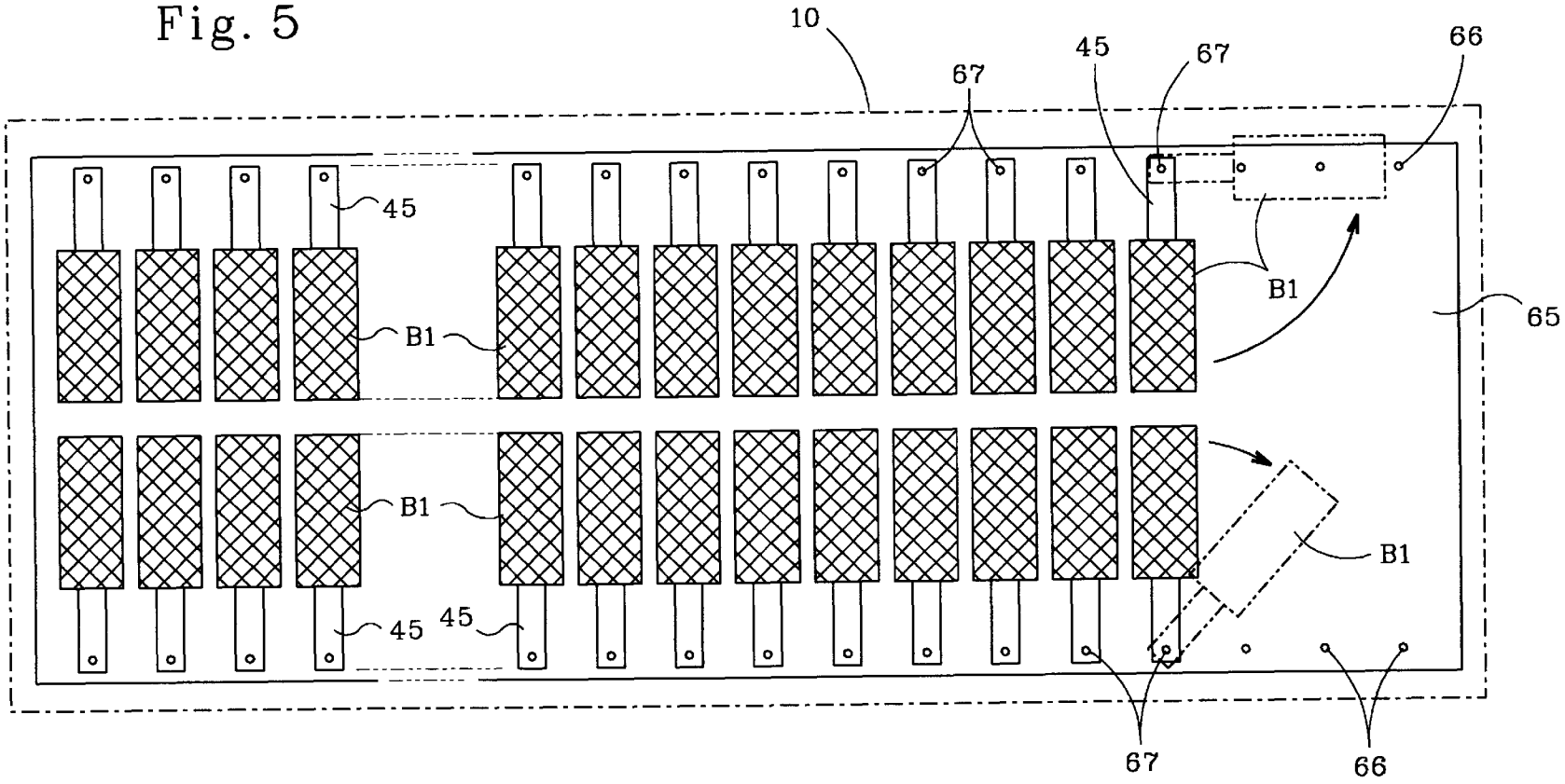
FIG. 5 is a plan view taken along the lines 5—5 of FIG. 3.

Referring to FIGS. 3 and 5, an arrangement for replenishing consumed anodes in the bottom basket called "shift and lift," comprises a nonconductive support plate 65 positioned in the tank bottom below the bottom baskets "B1." The support plate includes a plurality of spaced apart apertures 66 that communicate with pivot pins 67 extending outward from the hangers 45 that support the bottom containment baskets. This pivot pin arrangement enables operators to systematically remove the bottom baskets, during plating operations, for maintenance and replenishment of soluble anodes. For example, when the soluble anodes 13 are consumed to a level where distance "D," shown in FIG. 4, can no longer be maintained, the fasteners 49 are removed from the bus bars 12. This disconnects hangers 45 and the end basket hangers are rotated about the pivot points 67, as shown in FIG. 5, to a position where workers can lift the baskets from the plating tank for servicing.

Figure 6:
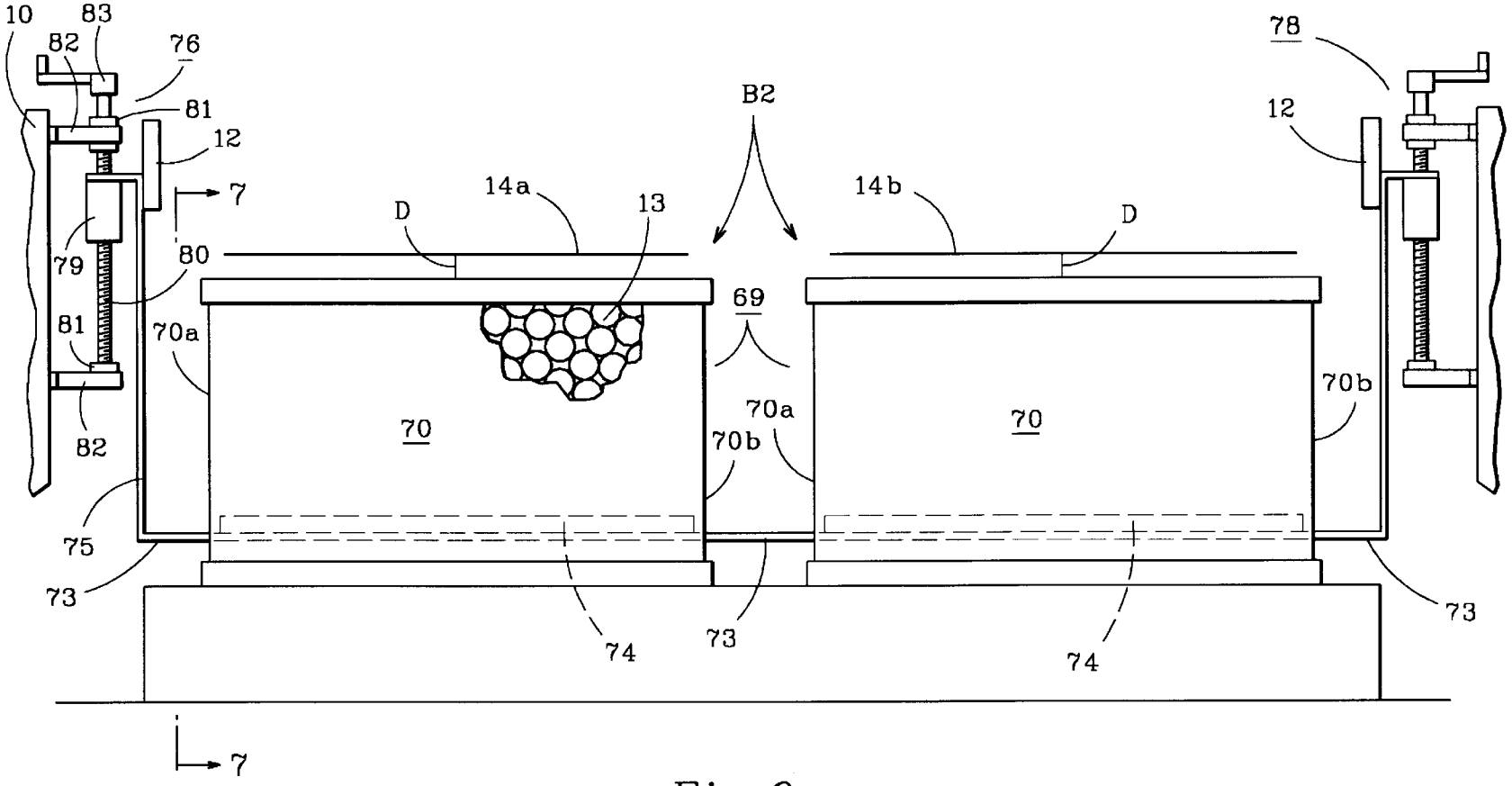
FIG. 6 is a transverse cross-section view showing an alternate bottom anode containment basket.

An alternate bottom anode containment basket "B2," called "jack the rack," is shown in FIGS. 6 and 7. This equivalent embodiment, shows the bottom containment baskets "B2"supported on pedestals 68 at the at the tank bottom. The bottom baskets comprise a conduit 69 similar to the above-described apparatus for basket "B1" and includes a continuous sidewall 70. However, in this embodiment, elongated slots 72 are axially aligned along opposite portions 70*a* and 70*b* of the continuous sidewall 70 to receive frame support arms 73 that extend through the interior space of conduit 69. The support arms are fastened to frame 74 of an anode support assembly that includes a conductive grid for supporting and delivering electrical energy to the soluble anodes 13 as described in the preferred embodiment. One end of the support arms 73 includes a hanger bar 75 that is attached to a jack means, 76 and the opposite end of the support arms 73 includes a hanger bar 77 attached to a second jack means 78. Jack means 76 and 78 are identical, and for simplicity, only one side of the jacking arrangement will be described.

Hanger 75 is fastened to a threaded collar 79 that travels along an elongated jackscrew 80. Both ends of the jackscrew include a bearing 81 and a yoke 82 to rotatably fasten the jackscrew to a support, for example the plating tank wall. A crank 83 is attached to one end of the jackscrew to provide a convenient means for rotating the screw. Hanger 75 is positioned to slidably engage the bus bar 12 that provides a continuous flow of electrical energy to the soluble anodes 13 at any selected elevation reached by cranking the jack. However, it should be understood that although I have shown a manual jacking arrangement maintaining a distance "D," any power jack arrangement, including an automatic arrangement calibrated to raise the anodes at selected intervals could be provided without departing from the scope of this invention.

A fabric filter bag 51, having elongated openings sewn into the fabric to correspond with slots 72 extending through the sidewall, encloses the conduit 69 (FIG. 7) with the support arms 73 extending outward through the fabric openings 84. The elongated openings are sewn into the bag correspond with slots 72 through the sidewalls 70 so that the anode support assembly can be jacked without interference from the filter bag. The end cap 52 is slipped over both open ends of the conduit to capture the filter bag 51 as described above.

During electroplating operations the level of soluble anodes contained in the nonconductive baskets are continually monitored to maintain the anodes within the proper plating distance "D" described above. Referring to the "shift and lift" arrangement in FIG. 5, when it is determined that the anodes have dropped to depth level that produces a noticeable loss in plating efficiency, the bottom baskets are rotated about pivots 67 to "shift" the baskets from below the moving substrate The operators then "lift" the baskets from the tank for servicing and anode replenishment.

In a like manner, when the top level of anode material falls near or below "D" in the "jack the rack" arrangement, cranks 83 are rotated to "jack" the anode support assembly, the "rack," to bring the top of the anodes within the preferred distance "D."

However, in the case of the top anode containment basket, the soluble anodes 13 are gravimetrically maintained at distance "D" and no special adjustment apparatus is required to maintain "D." As clearly shown in FIGS. 3 and 4, the soluble anodes 13 are loosely held within the interior space of the basket "T" and the anodes are supported on the conductive grid 36 that delivers electric energy to the anodes. As the anodes are consumed during the plating process they continually readjust themselves downward, toward the coating surface of the substrate, in response to the pull of gravity. Therefore, no jacking or adjustment arrangements, as disclosed for the bottom containment baskets "B1" and "B2,", are needed to maintain the anodes at a proper distance from the cathodic substrate.

While this invention has been described as having a preferred embodiment, it is understood that it is capable of further modifications, uses, and/or adaptations of the invention, following the general principle of the invention and including such departures from the present disclosure as have come within known or customary practice in the art to which the invention pertains, and as may be applied to the central features hereinbefore set forth, and fall within the scope of the invention of the limits of the appended claims.

I claim:

1. An anode containment basket for holding soluble anodes adjacent a surface of a substrate in a plating bath comprising:

a) a nonconductive conduit having a first open end opposite a second open end;

b) an end cap having a nonconductive open web mesh , said end cap attached to said conduit so that said nonconductive open web mesh covers said first open end of said conduit, and c) a conductive grid attached to an electric energy source and adapted to hold soluble anodes, said conductive grid positioned within said nonconductive conduit to place the soluble anodes adjacent said nonconductive open web mesh that covers said first open end of said conduit.

2. The apparatus recited in claim 1 wherein said anode containment basket includes:

a) hangers adapted to support said anode containment basket adjacent the surface of the substrate being plated.

3. The apparatus recited in claim 2 wherein said hangers support said anode containment basket at a position above the surface of the substrate being plated.

4. The apparatus recited in claim 3 wherein said continuous sidewall extends above the plating bath and is a perforated, said perforated nonconductive sidewall providing electrical insulation about the soluble anodes and said conductive grid, and said perforated nonconductive sidewall providing passageways for a continuous flow of electrolyte from the tank into said interior space.

5. The apparatus recited in claim 4 wherein said perforated nonconductive sidewall includes a plurality of apertures that extend through the sidewall and communicate with said interior space, the plurality of apertures having a total open surface area that provides a flow of electrolyte from the plating bath into said interior space greater than or equal to electrolyte consumed by the continuous plating line.

6. The apparatus recited in claim 5 wherein said total open surface area of said apertures is less than a remaining solid surface area in said perforated nonconductive sidewall.

7. The apparatus recited in claim 6 wherein said total open surface area of said apertures is equal up to about 25% of a total surface area in said perforated nonconductive sidewall.

8. The apparatus recited in claim 5 wherein said perforated nonconductive sidewall comprises:

a) a solid sidewall portion extending said first open end to about a depth of soluble anodes contained within said interior space, the depth being measured from about a top level of said soluble anodes to said first end; and b) a perforated sidewall portion extending between about the top level of the soluble anodes to said second open end.

9. The apparatus recited in claim 8 wherein said total open surface area of said apertures is less than a remaining solid surface area in said perforated nonconductive sidewall.

10. The apparatus recited in claim 9 wherein said total open surface area of said apertures is equal up to about 25% in a total surface area of said perforated nonconductive sidewall.

11. The apparatus recited in claim 3 wherein said nonconductive open web plastic mesh of said end cap is positioned a predetermined distance above the surface of the substrate being plated.

12. The apparatus recited in claim 11 wherein said predetermined distance is between about ⅜" to about ⅝".

13. The apparatus recited in claim 2 wherein said hangers support said anode containment basket at a position below the surface of the substrate being plated.

14. The apparatus recited in claim 13 wherein said continuous sidewall is a solid nonconductive sidewall providing electrical insulation about the soluble anodes and said conductive grid and said second end of the nonconductive conduit defines an open space for a flow of electrolyte from the plating bath in the tank into said interior space.

15. The apparatus recited in claim 14 wherein said conductive grid is positioned within the open space defined by said second end of said nonconductive conduit and the soluble anodes supported on said conductive grid extend toward said first end, said soluble anodes occupying the open space defined by said first end a predetermined distance below the surface of the substrate being plated.

16. The apparatus recited in claim 15 wherein said predetermined distance is between about ⅜" to about ⅝".

17. The apparatus recited in claim 15 wherein said anode containment basket is enclosed within a filter bag.

18. The apparatus recited in claim 17 wherein said filter bag is captured between said the soluble anodes and said nonconductive open web plastic mesh of the end cap.

19. The apparatus recited in claim 17 wherein:

a) said filter bag is captured between said nonconductive open web plastic mesh and the soluble anodes occupying the open space defined by said first open end; and b) said filter bag is captured between said nonconductive open web plastic mesh and said conductive grid positioned within the open space defined by said second open end.

20. The apparatus recited in claim 14 wherein said lift device includes:

a) at least one elongated slot extending through said continuous sidewall between said first open end and said second open end;

b) at least one jack means attached to said at least one hanger delivering electrical energy to said conductive grid; and c) at least one support arm extending through said elongated slot, said at least one support arm having a first end attached to said conductive grid and a second end attached to said at least one hanger so that said conductive grid attached to said support arm is raised or lowered within said interior space in response to operating said at least one jack attached to said at least one hanger.

21. The apparatus recited in claim 14 including a second end cap attached said nonconductive conduit, said second end cap including a nonconductive open web plastic mesh covering said open space defined by the second open end of said nonconductive conduit.

22. The apparatus recited in claim 13 including a device for maintaining the soluble anodes at said predetermined distance below the surface of the substrate being plated, said device providing means for removing said anode containment basket from the tank independent of plating line activity and comprising:

a) means for disconnecting said at least one hanger from the electrical energy source; and b) means to rotate said at least one hanger and pivot said anode containment basket from said position below the surface of the substrate being plated to a position parallel to a sidewall of the tank, and c) means to lift said anode containment basket vertically within a space between the substrate being plated and the sidewall of the tank.

23. The apparatus recited in claim 13 including a lift device for raising or lowering said conductive grid within said interior space of the anode containment basket to maintain the soluble anodes at said predetermined distance below the surface of the substrate being plated, said lift device providing means to raise or lower said conductive grid within said anode containment basket independent of plating line activity.

24. The apparatus recited in claim 1 wherein said anode containment basket is enclosed within a filter bag.

25. The apparatus recited in claim 24 wherein said filter bag is captured between said conductive grid and said nonconductive open web plastic mesh of the end cap.

26. A continuous coil electroplating line in which a sheet metal strip travels through a plating bath contained within a tank below anode containment baskets suspended within the plating bath, at least one of the anode baskets comprising:

a) a nonconductive conduit having a first open end opposite a second open end;

b) an end cap having a nonconductive open web mesh, said end can attached to said conduit so that said nonconductive open web mesh covers said first open end of said conduit, and c) a conductive grid attached to an electric energy source and adapted to hold soluble anodes, said conductive grid positioned within said nonconductive conduit to place the soluble anodes adjacent said nonconductive open web mesh that covers said first open end of said conduit.

27. The apparatus recited in claim 26 wherein a continuous sidewall is perforated and extends above the plating bath, said perforated sidewall providing electrical insulation about the soluble anodes and said conductive grid, and said perforated sidewall providing passageways for a continuous flow of electrolyte from the tank into an interior space means.

28. The apparatus recited in claim 27 wherein said perforated nonconductive sidewall includes a plurality of apertures that extend through the sidewall and communicate with said interior space means, the plurality of apertures having a total open surface area that provides a flow of electrolyte from the plating bath into said interior space greater than or equal to electrolyte consumed by the continuous plating line.

29. The apparatus recited in claim 28 wherein said interior space means is adapted to receive a flow of electrolyte created by a forced hydraulic action of the sheet metal strip moving through the plating bath.

30. The apparatus recited in claim 28 wherein said total open surface area of said apertures is less than a remaining solid surface area in said perforated nonconductive sidewall.

31. The apparatus recited in claim 30 wherein said total open surface area of said apertures is equal up to about 25% of a total surface area in said perforated nonconductive sidewall.

32. The apparatus recited in claim 28 wherein said perforated nonconductive sidewall comprises:

a) a solid sidewall portion extending said first open end to about a depth of soluble anodes contained within said interior space, the depth being measured from about a top level of said soluble anodes to said first end; and b) a perforated sidewall portion extending between about the top level of the soluble anodes to said second open end.

33. The apparatus recited in claim 32 wherein said total open surface area of said apertures is less than a remaining solid surface area in said perforated nonconductive sidewall.

34. The apparatus recited in claim 33 wherein said total open surface area of said apertures is equal up to about 25% of a total surface area in said perforated nonconductive sidewall.

35. The apparatus recited in claim 26 wherein said nonconductive open web plastic mesh of said end cap is positioned a predetermined distance above the surface of the substrate being plated.

36. The apparatus recited in claim 35 wherein said predetermined distance is between about ⅜" to about ⅝".

37. The apparatus recited in claim 26 wherein said anode containment basket is enclosed within a filter bag.

38. The apparatus recited in claim 37 wherein said filter bag is captured between said conductive grid and said nonconductive open web plastic mesh of said end cap.

39. A continuous coil electroplating line in which a sheet metal strip travels through a plating bath contained within a tank above anode containment baskets immersed within the plating bath, at least one of the anode baskets comprising:

a) a nonconductive conduit having a first open end opposite a second open end;

b) and end cap having a nonconductive open web mesh, said end cap attached to said conduit so that said nonconductive open web mesh covers said first open end of said conduit, and c) a conductive grid attached to an electric energy source and adapted to hold soluble anodes, said conductive grid positioned within said nonconductive conduit to to place the soluble anodes adjacent said nonconductive open web mesh that covers said first open end of said conduit.

40. The apparatus recited in claim 39 wherein:

a) a continuous sidewall is a solid nonconductive sidewall providing electrical insulation about the soluble anodes and said conductive grid; and b) a second end cap is attached to said nonconductive conduit, said second end cap including a nonconductive open web plastic mesh covering an open space defined by said second open end of said nonconductive conduit, said open space providing a passageway for a continuous flow of electrolyte from the tank into said interior space.

41. The apparatus recited in claim 40 wherein said nonconductive open web plastic mesh covering the open space of said first open end is positioned a predetermined distance above the surface of the substrate being plated.

42. The apparatus recited in claim 41 wherein said predetermined distance is between about ⅜" to about ⅝".

43. The apparatus recited in claim 40 wherein said anode containment basket is enclosed within a filter bag.

44. The apparatus recited in claim 43 wherein said filter bag is captured between the soluble anodes and said nonconductive open web plastic mesh covering said open space defined by said first open end.

45. The apparatus recited in claim 43 wherein said filter bag is captured between said conductive grid and said nonconductive open web plastic mesh covering said open space defined by said second open end.

46. The apparatus recited in claim 43 wherein:

a) said filter bag is captured between the soluble anodes and said nonconductive open web plastic mesh covering said open space defined by said first open end; and b) said filter bag is captured between said conductive grid and said nonconductive open web plastic mesh covering said open space defined by said second open end.

47. The apparatus recited in claim 39 including a lift device for raising or lowering said conductive grid within said interior space of the anode containment basket to maintain the soluble anodes at a predetermined distance below the surface of the substrate being plated, said lift device providing means to raise or lower said conductive grid independent of plating line activity.

48. The apparatus recited in claim 47 wherein said lift device includes:

a) at least one elongated slot extending through said continuous solid sidewall between said first open end and said second open end;

b) at least one jack means attached to said least one hanger that delivers electrical energy to said conductive grid; and c) at least one support arm extending through said elongated slot and having a first end attached to said conductive grid and a second end attached to said at least one hanger attached to said jack means so that said conductive grid is raised or lowered along with said support arm in response to operating said at least one jack.

49. The apparatus recited in claim 39 wherein said anode containment basket is enclosed within a filter bag.

* * * * *